US007201442B1

(12) United States Patent
Decosta, Jr.

(10) Patent No.: US 7,201,442 B1
(45) Date of Patent: Apr. 10, 2007

(54) CHAIR UMBRELLA BRACKET KIT

(76) Inventor: Albert Decosta, Jr., 1800 Keith Way, Sacramento, CA (US) 95815

( * ) Notice: Subject to any disclaimer, the term of this patent is extended or adjusted under 35 U.S.C. 154(b) by 0 days.

(21) Appl. No.: 11/513,861

(22) Filed: Aug. 31, 2006

(51) Int. Cl.
*A47C 7/66* (2006.01)

(52) U.S. Cl. ..... 297/184.16; 297/188.06; 248/539; 248/540; 135/16; 135/96

(58) Field of Classification Search ..... 297/184.16, 297/188.06, 188.2; 135/16, 90, 96, 98; 248/230.7, 248/511, 518, 534, 535, 539, 540
See application file for complete search history.

(56) References Cited

U.S. PATENT DOCUMENTS 3,845,985 A * 11/1974 Behrend et al. ..... 297/184.14
D250,300 S 11/1978 Rohr
4,318,567 A 3/1982 Guthier
4,334,692 A * 6/1982 Lynch ..... 135/16
4,781,411 A 11/1988 Kolb
4,789,200 A 12/1988 Munguia
5,255,954 A * 10/1993 Rogers ..... 297/184.16
5,967,601 A * 10/1999 Gillins ..... 297/184.15
6,244,557 B1 * 6/2001 Maze ..... 248/541
6,666,221 B1 12/2003 Booth

* cited by examiner

*Primary Examiner*—Peter R. Brown
(74) *Attorney, Agent, or Firm*—Lawrence J. Gibney, Jr.

(57) ABSTRACT

A device allowing its user to securely attach a large beach umbrella to the frame of a portable chair or chairs. The device has two mounting plates, which may be easily attached and removed from the frames of either one or two chairs. The umbrella pole will be inserted through a pair of compression fitting mechanisms, which are secured to the mounting plates. When not in use, the device may be easily dismantled, stored and carried in the same bag as the chair.

6 Claims, 4 Drawing Sheets

CHAIR UMBRELLA BRACKET KIT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

When participating in outdoor activities such as camping or the beach, portable chairs are often used when shade from the sun is desired. Often, a separate stand is required to allow the umbrella to remain upright. It would be desirable to have an umbrella, which could be temporarily secured to a portable chair or a pair of chairs and used outside.

A. Field of the Invention

The present invention relates to securing a portable shade umbrella to a camping chair or a pair of camping chairs.

B. Prior Art

Prior art exists that relates to securing an umbrella to a portable chair. The Mungia U.S. Pat. No. 4,789,200 claims a clamp means secured to the rear surface of a chair. The present invention improves on this prior art patent because it allows the user to secure the umbrella to the legs of a chair. The Rogers U.S. Pat. No. 5,255,954 claims the use of an endless rod structure to secure an umbrella to a chair. The present invention uses a bracket system instead of an endless rod. The Booth U.S. Pat. No. 6,666,221 claims a combination chair and umbrella.

The present invention is a removable device that allows a user to secure an umbrella to the legs of a chair, if desired and differs substantially for the features found in the prior art.

BRIEF SUMMARY OF THE INVENTION

The present invention is a removable bracket system by which an umbrella could be secured to the legs of a camping chair or pair of chairs. The present invention may be easily removed from the frame of the chair when not in use. No modifications are made to the chair as the system is mounted directly to the structure of the chair.

The present device would allow the camper or person in the outdoors to mount an umbrella to the back of the portable chair or chairs without concern for the type of terrain or the condition of the terrain.

Because of its exposure to the elements the device should be made from durable, non-corrosive material. Plastic is probably a suitable material.

It is an object of this device to allow an individual to mount an umbrella to the back of one chair or between two chairs.

Figure 1:
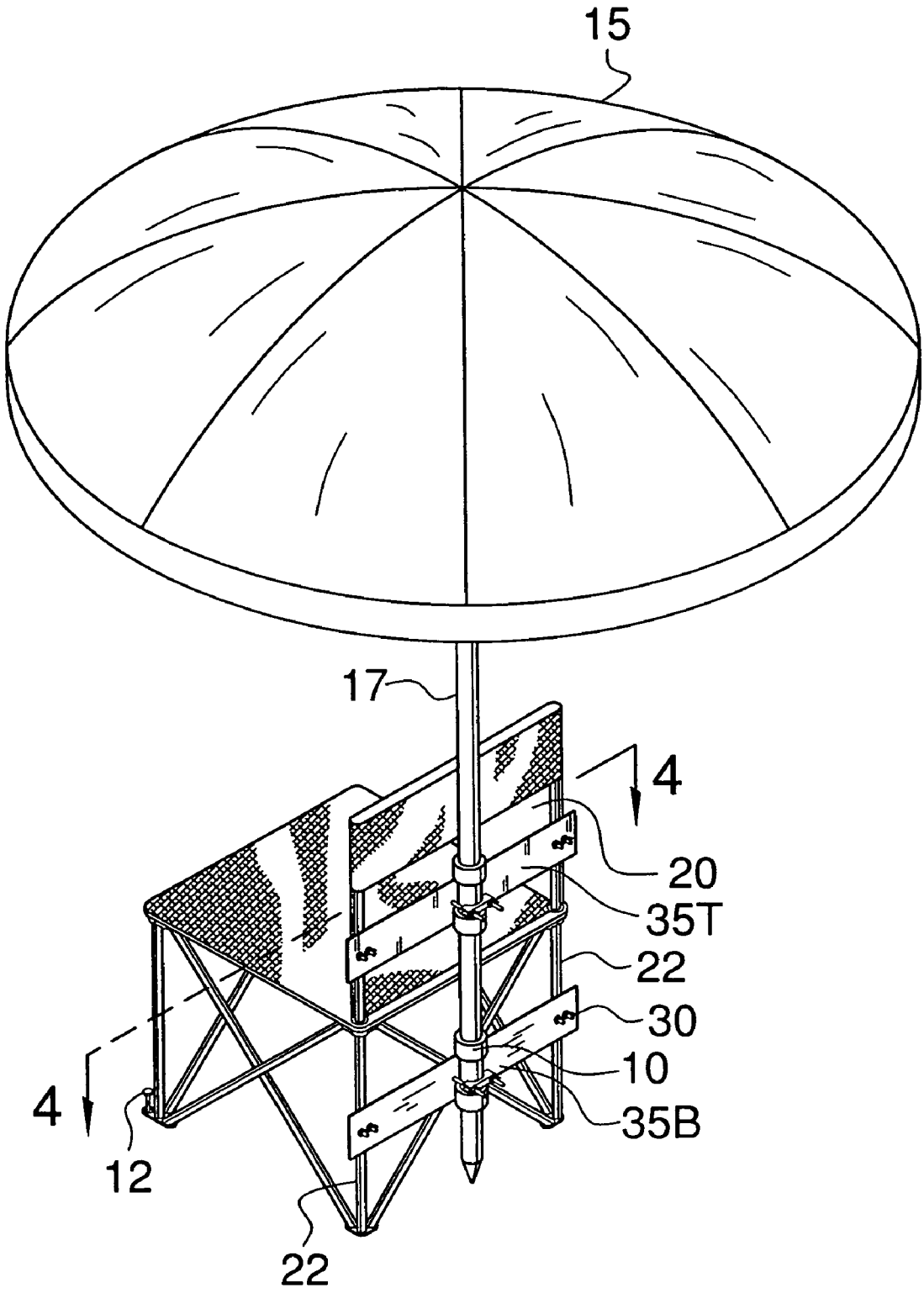
FIG. 1 is a perspective view of the device in use with a single camping chair.

| DRAWING REFERENCE NUMERALS | |
|---|---|
| 5 | Device |
| 10 | Compression Fitting |
| 12 | Chair peg |
| 15 | Patio umbrella |
| 17 | Umbrella pole |
| 20 | Back of chair |
| 22 | Back leg of chair |
| 25 | Back leg of chair when second chair is used |
| 26F | Flat washer |
| 26L | Lock washer |
| 27 | Wing nut |
| 28 | "U" bolt |
| 30 | "U" bolt, nut and washer assembly |
| 32 | "U" bolt, nut, washer, and clamp assembly |
| 33 | Clamp |
| 34F | Flat washer |
| 34L | Lock washer |
| 35B | Mounting plate (bottom) |
| 35T | Mounting plate (top) |
| 36 | Wing nut |

DETAILED DESCRIPTION OF THE EMBODIMENTS

Figure 2:
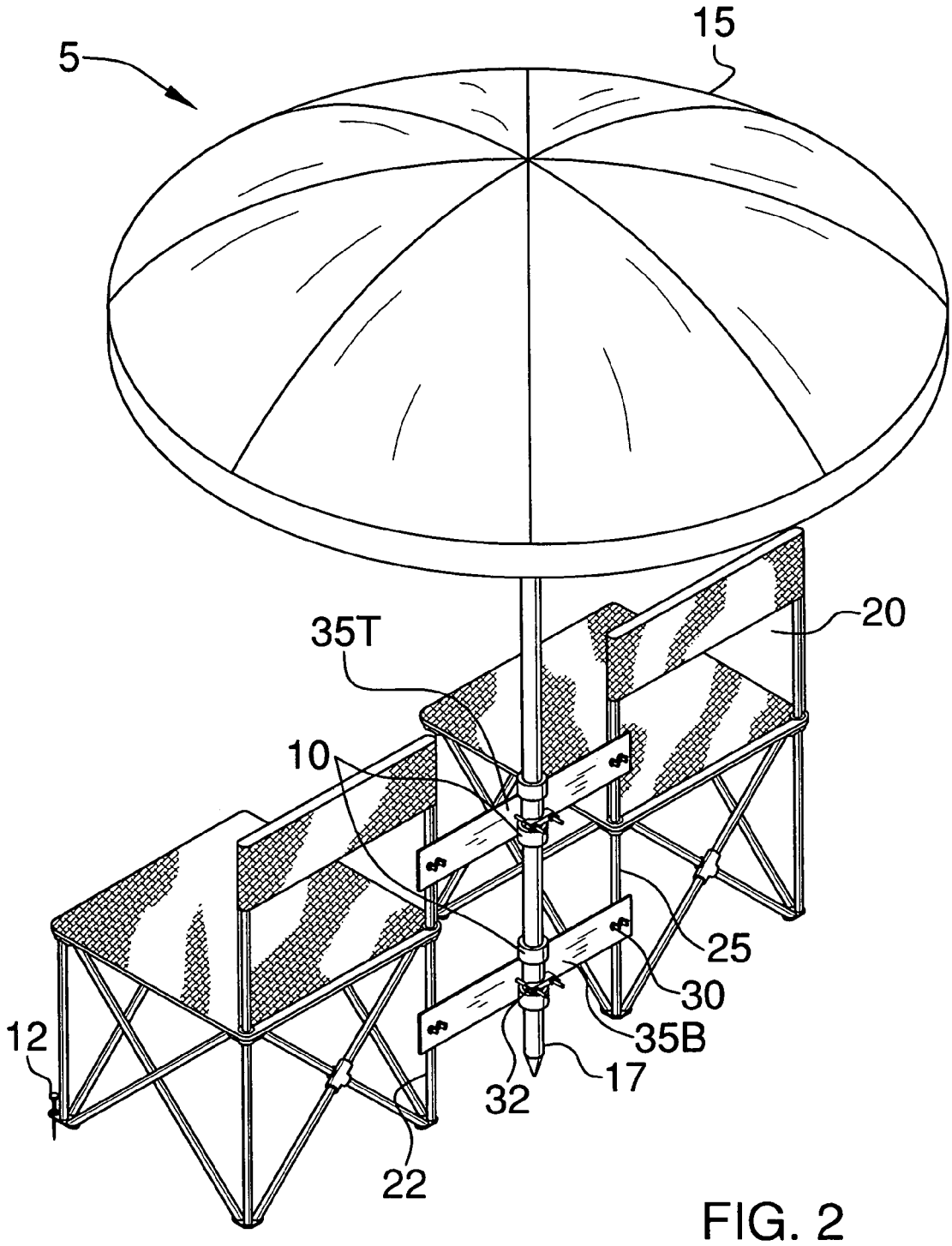
FIG. 2 is a perspective view of the device in use with a pair of camping chairs.

The present invention is a device 5 which allows its user to attach a beach or patio umbrella 15 to the back of a folding camping chair 20, which has tubular frame elements. The user must first unfold the chair 20. The user may or may not secure the bottom ends of the legs of the chair 20 to the ground through the use of chair pegs 12. FIGS. 1,2

First Embodiment

Figure 3:
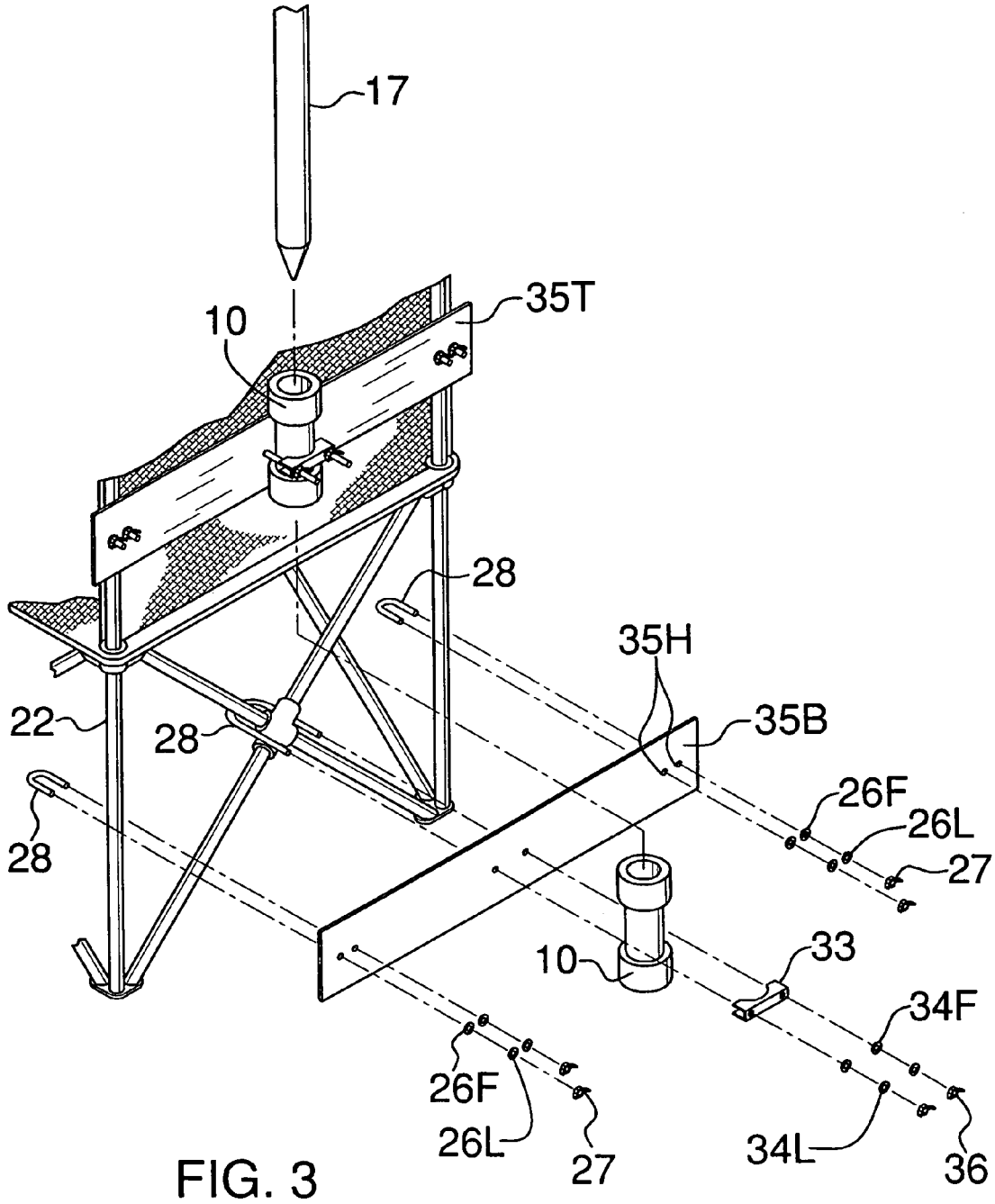
FIG. 3 is an exploded view of the device installed on a single camping chair.

In the first embodiment the user secures the top mounting plate 35T and the bottom mounting plate 35B to a desired location on the back leg of the chair 22. FIGS. 1,3 Because the plates must be able to support the weight of an umbrella 15 it should be made of sturdy material. The mounting plates are planar and of predetermined thickness and should be sturdy enough to support the weight of an umbrella.

Each mounting plate is identical in shape and has a plurality, preferably six, of holes 35H drilled through the mounting plates at desired locations. FIG. 3, 4 The six holes 35H are drilled in three pairs. One pair is drilled on one end, one pair is drilled in the center, and one pair is drilled on the opposite end. The position of the two outside sets of holes is determined by the specific location of the frame members of the chair. The middle set of holes is contemplated to be in the center of the respective mounting plates, 35B and 35T. FIGS. 1, 3

The bottom mounting plate 35B is aligned with the chair legs 22 below the seat of the chair. Once the desired location is determined, a "U" bolt 28 is inserted around the chair leg 22 and through the holes 35H on either end of the bottom mounting plate 35B. FIG. 3, 4 The portions of the "U" bolt which protrude through the holes are equipped with threaded ends. A flat washer 26F and a lock washer 26L are inserted over each threaded end and a wing nut 27 is screwed loosely at first to ensure alignment onto each threaded end. Although wing nuts are discussed to secure the device, other means of attachment may be used and may include lock nuts or bolts. The "U" bolts may be either round or square.

Figure 4:
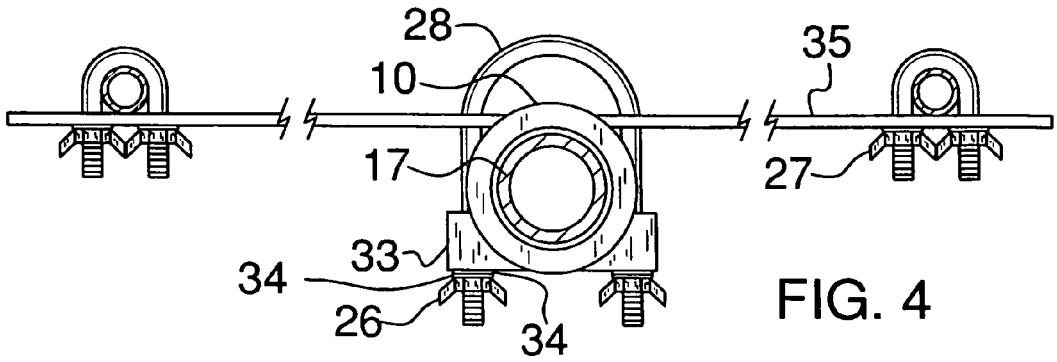
FIG. 4 is a top view of the device as taken along line 4—4 On FIG. 1.
Figure 5:
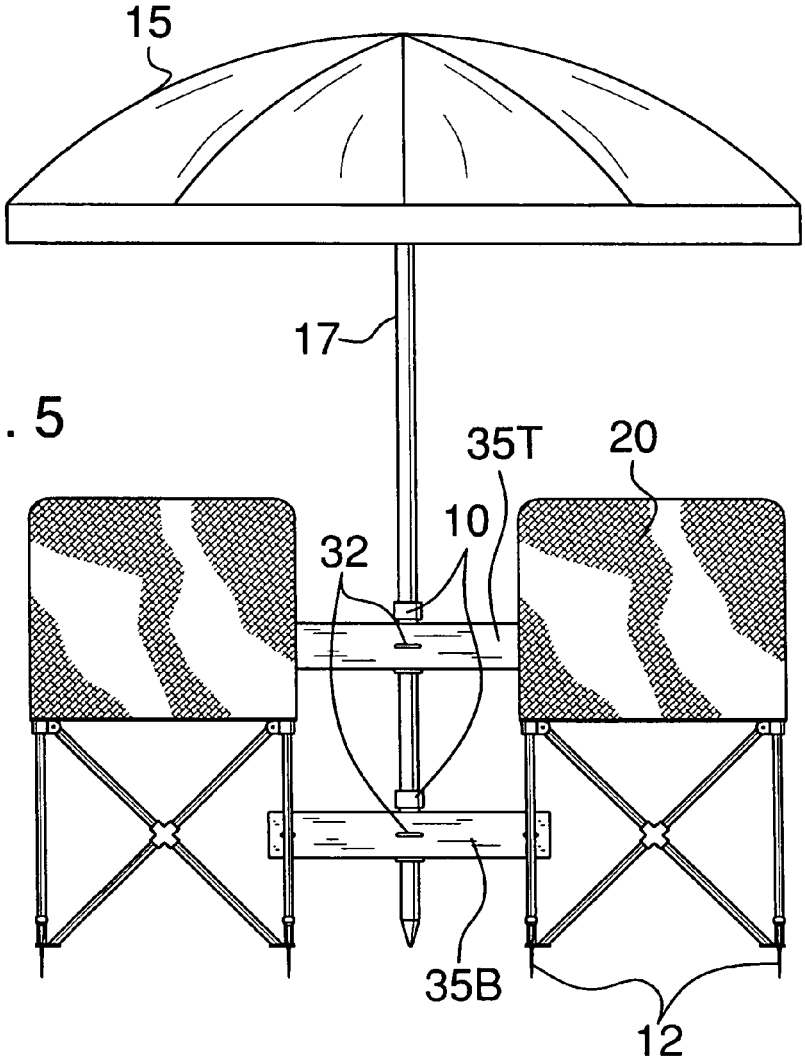
FIG. 5 is a front view of the device in use with a pair of camping chairs.

A third "U" bolt 30 is placed around the rear junction or crossed pieces of the rear center of the chair and is inserted through the center pair of holes in the bottom mounting plate 35B. A compression fitting 10 is inserted vertically between the protruding ends of the "U" bolt 30. FIG. 3, 4 A clamp 33 is inserted around the protruding ends in order to firmly secure the compression fitting 10 to the bottom mounting plate 35B. In order to secure the clamp 33, flat washers 34F and lock washers 34L are slipped over the protruding ends and wing nuts 36 are screwed tightly onto the threaded protruding ends of the "U" bolt 30. FIG. 4 Once tightened, the center assembly 32 provides stability to the user of the device 5 in the center of the device 5.

Once the mounting plates are secured to the frame of the chair and the means of securement is tightened and after the compression fittings 10 and the umbrella pole 17 is inserted through both compression fittings 10, the entire assembly 30 provides stability for the user of the device 5.

The next step is to secure the top mounting plate 35T to the chair; the top mounting plate 35T is aligned with the chair legs 22 above the sitting portion of the chair. Once the desired location is determined, a "U" bolt 28 is inserted around the chair leg 22 and through the holes on the ends of the mounting plate 35T. The portions of the "U" bolt which protrude through the holes are equipped with threaded ends. A flat washer 26F and a lock washer 26A are inserted over each threaded end and a wing nut 27 or other means of securement is screwed tightly onto each threaded end. FIG. 4

A third "U" bolt 30 is inserted through the center pair of holes in the top mounting plate 35T. A compression fitting 10 is inserted vertically between the protruding ends of the "U" bolt 30. A clamp 33 is inserted over the protruding ends in order to firmly secure the compression fitting 10 to the top mounting plate 35T. In order to secure the clamp 33, washers 34F and 34L are slipped over the protruding ends and wing nuts 36 are screwed tightly onto the threaded protruding ends of the "U" bolt 30. FIGS. 1,4

With the chair 20 unfolded and tent pegs 12 securing the feet of the chair legs 22 to the ground, the umbrella pole 17 may be inserted through the compression fitting 10 on the top mounting plate 35T and through the compression fitting 10 on the bottom mounting plate 35B and the device secured in place.

Second Embodiment

The second embodiment contemplates the use of this device with two camping chairs. If using a pair of chairs, the user secures one side of the mounting plates to one chair leg 22 and the other end to the other chair leg 25. FIG. 2 The top mounting plate 35T and the bottom mounting plate 35B are secured to the leg 22 of one chair and the leg 25 of another chair. The device 5 is attached using the same method as described above with the same hardware.

The inventor claims:

1. A device for removably securing a beach umbrella to a foldable chair with a tube-like frame comprising:

a. a top mounting plate of substantially rectangular and planar shape with a first and second end;

wherein said top mounting plates has a pair of holes drilled through the first end, a pair of holes drilled through the second end, and a pair of holes drilled in between the first and second end;

said top mounting plate is adapted to be secured to a chair above a chair seat;

b. a bottom mounting plate of substantially rectangular and planar shape and has a first and second end;

wherein said bottom mounting plate has a pair of holes drilled through the first end, a pair of holes drilled through the second end, and a pair of holes drilled in between the first and second end;

said bottom mounting plate is adapted to be secured to a chair below the seat of the chair;

c. a first and second compression fitting mechanism;

wherein the first and second compression fitting mechanisms are substantially cylindrical and hollow;

wherein the first and second compression fitting mechanisms have a first and second open end;

wherein a portion of an umbrella pole is adapted to be inserted through the compression fittings;

d. six "U" bolts with two protruding threaded ends;

wherein the each "U" bolt is sized to fit around the leg of a chair;

wherein the ends of the "U" bolts are threaded;

wherein the diameter of the "U" bolt is smaller than the diameter of the holes in the mounting plates;

e. Twelve flat washers;

f. Twelve lock washers;

g. Twelve securement mechanisms; and h. Two clamp mechanisms;

wherein the clamps are sized to fit around the compression fittings;

wherein the clamp mechanisms secure the compression fitting mechanisms to the top and bottom mounting plates;

said clamp mechanisms are secured to the top and bottom mounting plates using a plurality of said "U" bolts and securement mechanisms.

2. The device as described in claim 1 wherein the securement mechanism is a wing nut.

3. The device as described in claim 1 wherein the securement mechanism is a bolt.

4. A method for assembling the device described in claim 1 comprising the following steps:

a. Selecting a desired number of foldable chairs with tube-like frames;

b. Horizontally aligning the bottom mounting plate with the frame structure of the chair below the seat portion of the chair such that one frame member of the chair rests between the pair of holes in the first end of the bottom mounting plate and another frame rests between the pair of holes in the second end of the bottom mounting plate;

c. Placing one "U" bolt over the frame member and inserting the protruding threaded ends through the pair of holes in the first end of the bottom mounting plate;

d. Placing one "U" bolt over the frame member of the chair and inserting the protruding threaded ends through the pair of holes in the second end of the bottom mounting plate;

e. Inserting a flat and lock washer over each protruding threaded end of each "U" bolt and tightly screwing a wing nut onto each protruding threaded end;

f. Placing a compression fitting "U" bolt around the rear junction or center of the frame member and inserting the protruding threaded ends of a "U" bolt through the pair of holes in the middle of the first mounting block, placing the first compression fitting mechanism vertically between the protruding threaded ends of the "U" bolts, inserting a clamp mechanism onto the "U" bolts to rest against the compression fitting mechanism, inserting a flat and lock washer over each protruding threaded end of the "U" bolt and tightly screwing a wing nut onto each protruding threaded end;

g. Horizontally aligning the top mounting plate with the frame member of the chair above the seat portion of the chair such that one frame rests between the pair of holes in the first end of the top mounting plate and another frame member rests between the pair of holes in the second end of the top mounting plate;

h. placing one "U" bolt over the frame member and inserting the protruding threaded ends through the pair of holes in the first end of the second mounting plate;

i. Placing one "U" bolt over the frame and inserting the protruding threaded ends through the pair of holes in the second end of the top mounting plate;

j. Inserting a flat and lock washer over each protruding threaded end of each "U" bolt and tightly screwing a wing nut onto each protruding threaded end;

k. Inserting the protruding threaded ends of a "U" bolt through the pair of holes in the middle of the top mounting plate, placing the first compression fitting mechanism vertically between the protruding threaded ends of the "U" bolts, inserting a clamp mechanism onto the "U" bolts to rest against the compression fitting mechanism, inserting a flat and lock washer over each protruding threaded end of the "U" bolt and tightly screwing a wing nut onto each protruding threaded end; and l. Slidably inserting the pole of a beach umbrella through both compression fitting mechanisms so that the pole rests above the ground.

5. The device as described in claim 1 wherein the top and bottom mounting plates are secured to a frame member of a single chair.

6. The device as described in claim 1 wherein the top and bottom mounting plates are secured to a frame member of one chair and a frame member of another chair.

* * * * *